US005727491A

United States Patent [19]

Emrich et al.

[11] Patent Number: 5,727,491

[45] Date of Patent: Mar. 17, 1998

[54] PONTOON FOR MILITARY COLLAPSIBLE FLOATING BRIDGES AND CROSSING FERRIES

[75] Inventors: Lothar Emrich, Rehweiler; Gerhard Thieme, Kaiserslautern, both of Germany

[73] Assignee: Eisenwerke Kaiserslautern GmbH, Kaiserslautern/Pfalz, Germany

[21] Appl. No.: 763,239

[22] Filed: Dec. 10, 1996

Related U.S. Application Data

[63] Continuation of Ser. No. 657,408, Jun. 3, 1996, abandoned.

[30] Foreign Application Priority Data

Oct. 18, 1995 [DE] Germany ..... 295 16 480 U

[51] Int. Cl.[6] ..... B63B 1/00

[52] U.S. Cl. ..... 114/61; 114/353; 114/2.6

[58] Field of Search ..... 114/26, 61, 123, 114/2.6, 353

[56] References Cited

U.S. PATENT DOCUMENTS 4,972,538 11/1990 Parramore ..... 14/2.6

FOREIGN PATENT DOCUMENTS 1966374 9/1972 Germany .

3004397 8/1981 Germany .

3510778 9/1986 Germany .

OTHER PUBLICATIONS

Militärtechnik, Apr. 1972 pp. 182–183.

*Primary Examiner*—Stephen Avila

*Attorney, Agent, or Firm*—Cohen, Pontani, Lieberman & Pavane

[57] ABSTRACT

A pontoon for military collapsible floating bridges and crossing ferries, including two inner floatation bodies and two outer floatation bodies, which are connected to one another by simple hinges. The outer floatation bodies have, adjacent to the inner floatation bodies, a slightly rising, level first deck section and, attached to this and forming a step, another rising, level second deck section. Furthermore, the outer bodies have a lateral wall, which forms a freeboard that acts as an over-wash protection. The inner and outer floatation bodies can be folded into a W-shape for transport. When folded the second deck section of the outer floatation bodies lies flat on the deck of the inner floatation bodies. The bottom of the outer floatation bodies is flat and is aligned with the bottom of the inner floatation bodies. The outer floatation bodies are wider than the inner floatation bodies. So that the center of buoyancy of the outer floatation bodies is as far as possible from the hinge. The lateral wall is a circular cylindrical section which intersects with the bottom so that the tangential plane on the intersection line with the bottom encompasses an angle of approximately 10 to 20 degrees.

5 Claims, 3 Drawing Sheets

PONTOON FOR MILITARY COLLAPSIBLE FLOATING BRIDGES AND CROSSING FERRIES

This application is a continuation of Ser. No. 08/657,408 filed Jun. 3, 1996, now abandoned.

BACKGROUND OF THE INVENTION

1. Field of the Invention

The invention relates to pontoons for military collapsible floating bridges and crossing ferries. More particularly, the invention relates to a pontoon comprised of two inner floatation bodies and two outer floatation bodies, which are connected to one another by single-jointed hinges.

2. Description of the Prior Art

Pontoons of the generic, above-mentioned type are included in the equipment of engineer units in many modem armies. These pontoons provide a way to overcome wide and medium-sized water obstacles without substantially reducing the speed at which the units are advancing. Originally developed by the Soviet Army, pontoons were later adopted by the U.S. Army and are today found throughout the NATO military forces. Each pontoon consists of two inner floatation bodies and two outer floatation bodies, which are connected to one another by means of single-jointed hinges in a way that allows them to be folded up into a W-shape and then unfolded again. For ground transport, pontoons are folded up and carried on the beds of special trucks. The pontoons can be easily released from the truck bed and rolled into the water. There they unfold due to buoyant force as well as the springs and pulling cables provided and are linked together by means of deck connections and bottom locks into a relatively rigid pontoon body.

In order to construct bridges or crossing ferries, individual pontoons are connected closely to one another, so that a continuous bridge span is created. Special tug boats are used to maneuver the pontoons, ferries and bridges.

A description of Soviet bridge pontoons is found in the periodical *Military Technology* ("*Militär-Technik*"), 4/72, pp. 182–183. The collapsible floating bridge in the version used by NATO is described, among other places, in DE 30 04 397 C2. These pontoons share the following common features: The inner floatation bodies are parallelepiped. Adjacent to the inner floatation bodies, the outer floatation bodies have a first deck section, which is aligned with the deck of the inner floatation bodies. Attached to this, so as to form a step, is a second deck section, which extends to the lateral edges of the outer floatation body, rising slightly as it does so. The bottom of the outer floatation bodies is curved sharply and turns into a lateral wall that rises at an angle of approximately 30 degrees. The lateral edges of the outer floatation bodies thus form a freeboard, which acts as an over-wash protection.

An M-shaped collapsible pontoon is the subject matter of DE-AS 19 66 374. In contrast to those described above, this pontoon has inner and outer floatation bodies with a continuous level deck, a continuous level bottom and level lateral walls that rise relatively steeply. The lateral edges of the outer floatation bodies are designed as curb borders extending over the roadway.

A W-shaped collapsible pontoon is also disclosed in DE 35 10 778 C. The inner and outer floatation bodies of this pontoon have a continuous level deck and a continuous level bottom as well as shallowly rising side walls; the transition from the level bottom to the level side walls is rounded.

Along the lateral edges of the outer floatation bodies, surge plates are mounted. The outer floatation bodies are so wide that the surge plates extend over the inner floatation bodies when the pontoon is folded up. Thanks to its larger outer floatation bodies, this last-mentioned pontoon has greater carrying capacity (MLC 70) than the generic NATO collapsible floating bridge (MLC 60). However, in order to guarantee full collapsibility, the outer floatation bodies must be connected to the inner floatation bodies by means of double-jointed hinges. As a result, when the pontoon is taken out of the water, the outer floatation bodies do not always fold up automatically, which naturally impedes the rapid dismantlement of the ferries and bridges. Furthermore, the completely level deck has no orientation aids for the drivers of vehicles, as NATO pontoon bridges have in the form of the so-called "sidewalk step." The possibility, conceivable in principle because of the completely level deck, of maintaining traffic in both directions on the pontoon bridge, cannot be implemented in practice, because there is danger of tipping over when there is an off-center load. Furthermore, an analysis of military requirements suggests that two-way traffic is not necessary to begin with, because troops are always headed either to or from the from. A further significant disadvantage is that if the pontoon is so heavily loaded that water spills over onto the roadway and this is not noticed in time due to darkness, fog or enemy action, it will no longer be possible to take countermeasures, because the pontoon will already be sinking. Finally, in order to handle this pontoon, it was necessary to design new transport and loading devices, so that full interoperability with NATO pontoons no longer exists.

SUMMARY OF THE INVENTION

Accordingly, it is an object of the present invention is to provide a pontoon of the type mentioned above, which is completely compatible with the pontoons already in use and uses the same simple hinges and thus has the same unfolding characteristics as these pontoons, which can be transported by the same vehicles on the same transport routes and can be put into and removed from the water in the same manner as those already in use, which pontoon offers orientation aids to vehicle drivers and which, in particular, has higher carrying capacity and lower water resistance than the conventional pontoons.

Pursuant to this object, and others which will become apparent hereafter, one aspect of the present invention resides in a pontoon for a collapsible folding bridge, which is comprised of two inner floatation bodies each having a flat upper deck and a flat bottom, and two outer floatation bodies each having a flat bottom, a first upwardly sloped flat deck section adjacent to an inner floatation body, a second upwardly sloped flat deck section attached to the first deck section so as to form a step, and a lateral wall between the flat bottom and the second deck section so as to form a freeboard that acts as over-wash protection. The lateral wall is a circular cylindrical section that intersects the flat bottom so that a tangential line at the intersection between the lateral wall and the flat bottom, as seen in cross-section, encloses an angle with the flat bottom of 10–20 degrees. Hinge means are provided for connecting the flotation bodies to one another so that they can be folded into a W-shaped configuration in which the second deck section of the outer floatation bodies lies flat on the upper deck of the adjacent inner floatation body. The outer floatation bodies are wider than the inner floatation bodies so that the outer bodies extend beyond the inner bodies in the folded condition and so that the center of buoyancy of the outer floatation bodies is as far as possible from the hinge means.

Surprisingly, it was found that lateral walls do not need to be level and inclined at an angle of approximately 30 degrees in order to achieve low water resistance. Instead, circular cylindrical lateral walls also meet this condition, since the circular cylindrical shape ensures greater buoyant force and, in particular, displacement of the center of buoyancy outward. Because the lateral walls turn into the bottom with a bend, a sort of breaking edge is formed here, which contributes to the low water resistance. Thanks to the two rising deck sections of the outer floatation bodies, which are set off from one another by a step, the pontoon still has sufficient reserve buoyancy volume to safely prevent sinking, even if loaded to the extent that water washes over the roadway, i.e., the deck of the inner floatation bodies. Design modifications relative to the pontoons already in use have been made only where these do not interfere with full interoperability.

According to an advantageous further embodiment of the invention, the lateral edges of the outer floatation bodies, when folded up, extend over the inner floatation bodies. This extension in dimension also serves to increase the modified volume and thus the buoyant force, while not exceeding the maximum permissible dimensions for transport.

Preferably, when folded up, the center axes of the lateral wall cylindrical sections lie roughly in the center of the adjacent inner floatation body, which agrees exactly in size, as mentioned, with the inner floatation bodies of the pontoons which have been in use for many years. Surprisingly, this shape has proved, under the given basic conditions, to provide the best compromises in respect to high buoyancy, outwardly-located center of buoyancy, and low water resistance.

In yet another embodiment of the invention, the first deck section rises more shallowly than the second deck section. This measure results in good travelability as well as a high freeboard, so that both good over-wash protection and high reserve buoyancy, contributing to safety, are attained simultaneously. Finally, these superelevations of the lateral edges provide vehicle drivers with a good optical guidance aide, while the gradients directed toward the center offer a mechanical guidance aid as well.

The various features of novelty which characterize the invention are pointed out with particularity in the claims annexed to and forming a part of the disclosure. For a better understanding of the invention, its operating advantages, and specific objects attained by its use, reference should be had to the drawing and descriptive matter in which there are illustrated and described preferred embodiments of the invention.

DETAILED DESCRIPTION OF THE PREFERRED EMBODIMENTS

Figure 1:
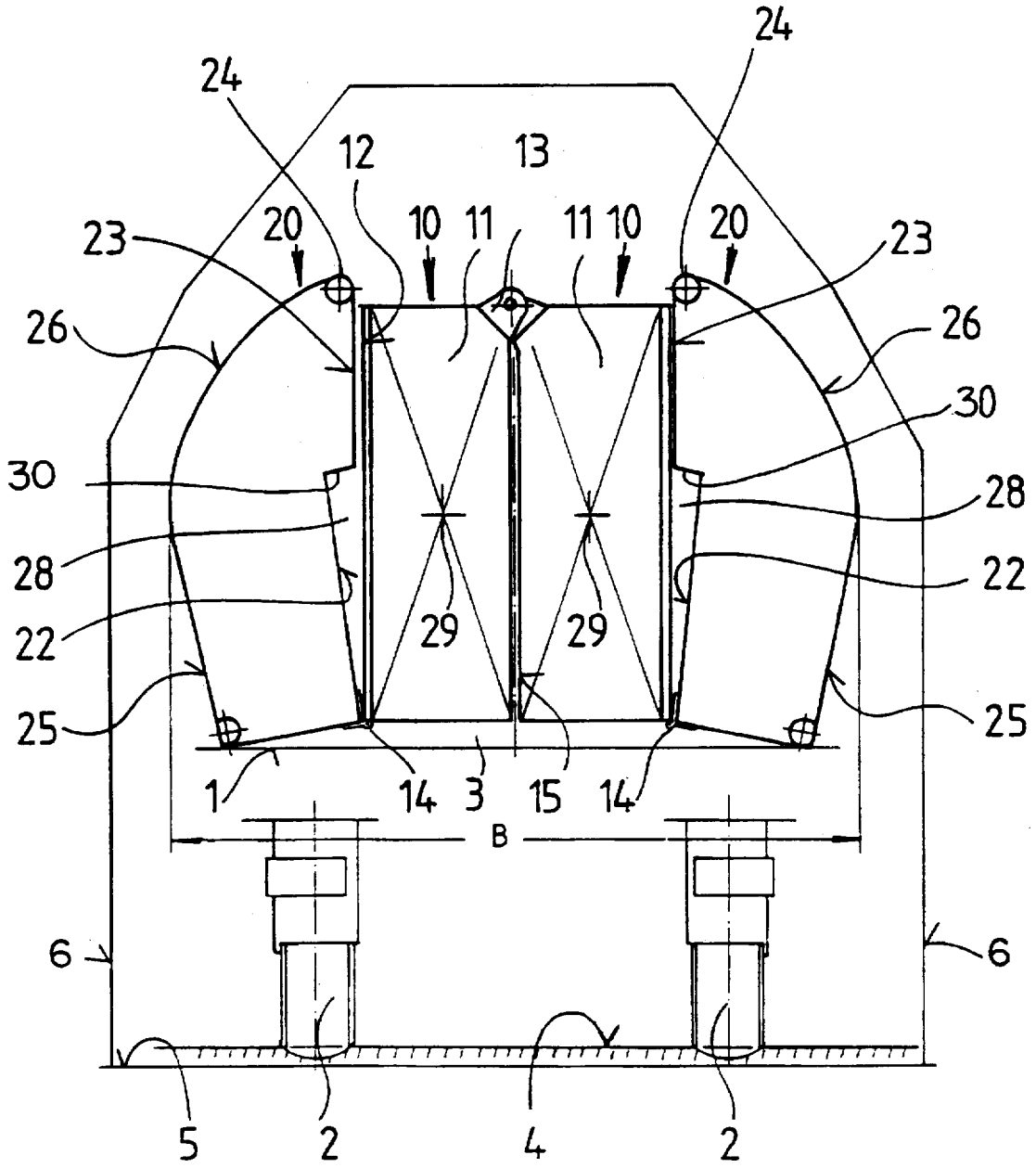
FIG. 1 is a schematic top view of the front of a folded-up pontoon pursuant to the present invention, loaded on a schematically illustrated track.

FIG. 1 shows a pontoon pursuant to the present invention for military collapsible floating bridges and crossing ferries, comprising two inner floatation bodies 10 and two outer floatation bodies 20, which are folded in a roughly W-shape to have an overall width B. The floatation bodies 10, 20 can be foamed in order to increase strength and, particularly, in order to make the pontoon unsinkable in the event of damage. The pontoon rests on the indicated bed 1 of a truck, of which only the wheels 2 travelling on the road surface 4 are shown. Drawn around the truck and pontoon is the structural clearance 6 required for the German Railroad system, as well as the rail surface 5.

The inner floatation bodies 10 consist of parallelepiped hollow bodies 11 with planar deck 12 and a planar bottom 15. The two inner floatation bodies 10 are connected to one another via single-jointed hinges 13.

The outer floatation bodies 20 are also attached via single-jointed hinges 14 to the inner floatation bodies 10. Because of the simple hinges 14, the swivel angle is limited to values below 180 degrees. In this way, an empty space 3 is created between the loading bed 1 and the pontoon, where the loading crane used for removing the pontoon from the water is normally stored.

The outer floatation bodies 20 have a width so that their lateral edges 24 extend, when folded up, over the inner floatation bodies 10. The enlargement in volume resulting from this leads to a first increase in carrying capacity.

However, the essential increase in carrying capacity results from the different design of the lateral walls 26 of the outer floatation bodies 20. These walls 26 are designed as circular cylindrical sections which have a radius R so that the center axes 29 thereof, when the pontoon is folded up, lie approximately in the center of the inner floatation bodies 10 and intersect with the flat bottom 25 of the outer floatation bodies 20, as will be explained in detail below in reference to FIG. 2.

As shown in FIG. 1, the outer floatation bodies 20 have, adjacent to the inner floatation bodies 10, a first deck section 22. Set back from the first deck section 22 by a step 30 is a second deck section 23. When the pontoon is folded up, the second deck section 23 lies flat on the deck 12 of the inner floatation bodies 10 in a known manner. As a result, a triangular gusset or wedge region 28 is created, as is also known from pontoons already in use.

Figure 2:
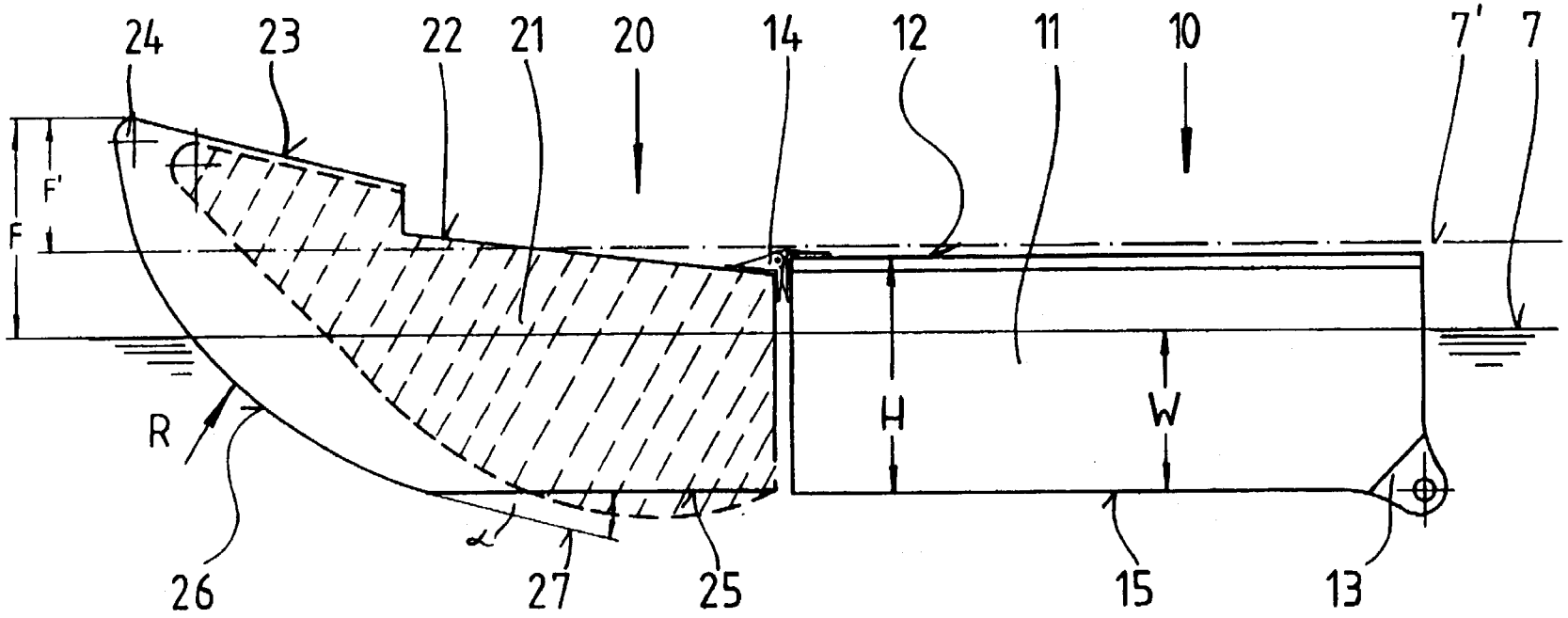
FIG. 2 is a view of the front of an unfolded pontoon floating in the water, with an actual NATO pontoon indicated as well.

FIG. 2 shows the unfolded pontoon floating in the water. In order to illustrate the modifications in the present invention, a generic NATO pontoon is also shown in dashed lines in correct scale and position. For the sake of clarity, only half of the pontoon is pictured. It can be seen that the flat bottom 25 of the outer floatation body 20 is aligned with the bottom 15 of the inner floatation body 10 which has a height H. Although the flat shape of the bottom 25 does somewhat reduce the total buoyancy, the center of buoyancy in the outer floatation body 20 is shifted outward, as desired. Furthermore, this drawing shows the lateral wall 26 in the form of a cylindrical section, which intersects with the flat bottom 25 in such a way that a tangential plane 27 placed on the intersection line at the lateral wall cylindrical section 26 encompasses a plane angle $\alpha$ of approximately 10 to 20 degrees, preferably approximately 15 degrees, with the flat bottom 25. This combination of the flat bottom 25, the lateral wall 26 in the shape of a circular cylindrical section, and the angle $\alpha$ combines high buoyancy volume with a center of buoyancy located far to the outside and low water resistance. Comparing the contours of the conventional NATO pontoon and the pontoon according to the invention illustrates this increase in performance.

As FIG. 2 also shows, the first deck section 22 of the outer floatation body 20 rises slightly relative to the deck 12 of the inner floatation body 10. Attached to this, forming the step 30, is the second deck section 23, which rises more sharply and finally forms, along with the lateral wall 26, the lateral edge 24 of the outer floatation body 20. Due to the gradients of the two deck sections 22, 23 and the enlargement in dimensions, the outer edges 24 of the outer floatation bodies 20 have a considerable freeboard F above the water line 7 when (as shown here) the pontoon is loaded with the nominal load MLC 70 and submerged to the standard water depth W.

If, due to overloading or damage from enemy action, the water line 7' rises above the deck 12 of the inner floatation bodies 10, considerable portions of the outer floatation bodies 20 will still remain above the water line 7' as shown by F'. Thanks to this reserve buoyancy volume, the pontoon will not sink under even such an extreme overload, and operating personnel will have the opportunity to calmly take suitable countermeasures.

Figure 4:
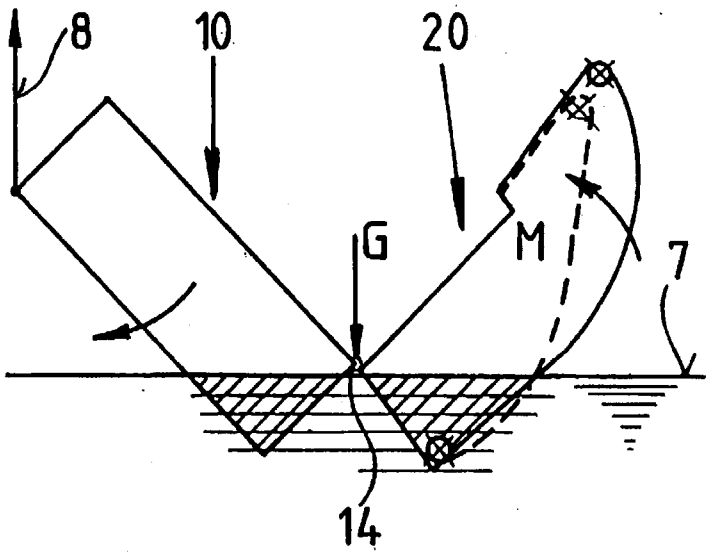
FIGS. 3 & 4 schematically show, respectively, two typical positions as the pontoon is taken out of the water by a loading crane.
Figure 3:
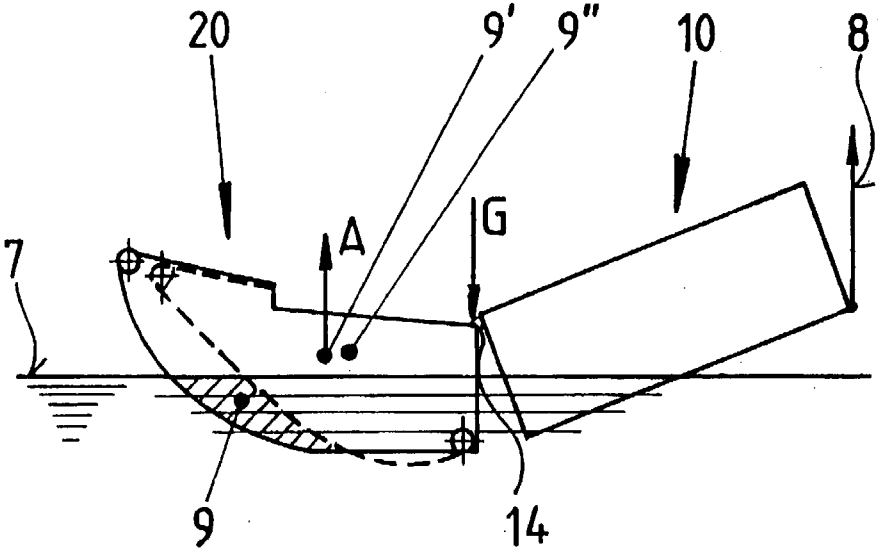

Schematically, FIGS. 3 and 4 show the buoyancy and load pressure forces when the pontoon according to the invention is taken out of the water; again, the NATO pontoon is shown for comparison. Thanks to the enlarged buoyancy volume 9, the center of buoyancy 9' of the outer floatation body 20 according to the invention lies further to the outside than the center of buoyancy 9" of the NATO pontoon. When the pontoon is removed from the water, the inner floatation bodies 10 are lifted out of the water by a lifting cable 8. The absent buoyant force is thereby compensated for by a weight G, which acts on the outer floatation body 20 via the hinge 14. This weight G acts in a manner offset to the buoyancy force A on the outer floatation body 20. The resulting torque M (FIG. 4) automatically folds the outer floatation body 20, as shown by Arrow M. The additional buoyancy volume 9 and the outwardly-shifted center of buoyancy 9' intensify this torque, speeding up the folding of the pontoon when it is removed from the water.

The invention is not limited by the embodiments described above which are presented as examples only but can be modified in various ways within the scope of protection defined by the appended patent claims.

I claim:

1. A pontoon for a collapsible folding bridge and crossing ferry, comprising:

two inner floatation bodies each having a flat upper deck and a flat bottom; two outer floatation bodies each having a flat bottom aligned with the bottom of the inner floatation bodies, a first upwardly sloped flat deck section adjacent an inner floatation body, a second upwardly sloped flat deck section attached to the first deck section so as to form a step, and a lateral wall between the flat bottom and the second deck section so as to form a freeboard that acts as over-wash protection, the lateral wall being a circular cylindrical section that intersects the flat bottom so that a tangential line at the intersection encompasses an angle of 10–20 degrees with the flat bottom, the outer floatation bodies being wider than the inner floatation bodies; and hinge means for connecting the bodies to one another so that the floatation bodies can be folded into a W-shaped configuration in which the second deck sections of the outer floatation bodies lie flat on the upper decks of the adjacent inner floatation bodies and so that the outer bodies extend beyond the inner bodies.

2. A pontoon according to claim 1, wherein the outer flotation bodies are configured so that a center axis of the lateral wall of the cylindrical section lies roughly at a center of an adjacent inner floatation body when the pontoon is folded.

3. A pontoon according to claim 1, wherein the first deck section is configured to have a lower slope than the second deck section.

4. A pontoon as defined in claim 1, wherein the floatation bodies are at least partially formed of foamed material.

5. A pontoon as defined in claim 1, wherein the angle between the bottom and the tangential line is 15 degrees.

* * * * *

UNITED STATES PATENT AND TRADEMARK OFFICE
CERTIFICATE OF CORRECTION

PATENT NO. : 5,727,491

DATED : March 17, 1998

INVENTOR(S) : Lothar EMRICH and Gerhard THIEME

It is certified that error appears in the above-identified patent and that said Letters Patent is hereby corrected as shown below:

On the title page, item [73], Assignee should read

EWK Eisenwerke Kaiserslautern GmbH
Kaiserslautern/Pfalz, Germany

Signed and Sealed this

Second Day of March, 1999

*Attest:*

Q. TODD DICKINSON

*Attesting Officer*

*Acting Commissioner of Patents and Trademarks*